US009005006B2

(12) United States Patent
Haykin et al.

(10) Patent No.: US 9,005,006 B2
(45) Date of Patent: Apr. 14, 2015

(54) GAMING DEVICE HAVING WILD SYMBOL GENERATION WITHIN A PLAY MATRIX

(75) Inventors: Brian T. Haykin, Hawthorne, NJ (US); Aaron Stuart Zoble, Ramsey, NJ (US); Anthony Singer, Ramsey, NJ (US); Philip B. Welty, Suffern, NY (US)

(73) Assignee: IGT, Las Vegas, NV (US)

( * ) Notice: Subject to any disclaimer, the term of this patent is extended or adjusted under 35 U.S.C. 154(b) by 210 days.

(21) Appl. No.: 13/572,583

(22) Filed: Aug. 10, 2012

(65) Prior Publication Data

US 2013/0184047 A1 Jul. 18, 2013

Related U.S. Application Data

(60) Provisional application No. 61/522,113, filed on Aug. 10, 2011.

(51) Int. Cl.
*A63F 13/00* (2014.01)
*G07F 17/32* (2006.01)

(52) U.S. Cl.
CPC ..... *G07F 17/326* (2013.01); *G07F 17/3265* (2013.01)

(58) Field of Classification Search
CPC ..... A63F 13/10; G07F 17/32; G07F 17/326; G07F 17/3265; G07F 17/3267
USPC ..... 463/16, 20, 21, 25
See application file for complete search history.

(56) References Cited

U.S. PATENT DOCUMENTS 4,198,052 A 4/1980 Gauselmann
4,448,419 A 5/1984 Telnaes
4,695,053 A 9/1987 Vazquez et al.
4,836,546 A 6/1989 Dire et al.
4,838,552 A 6/1989 Hagiwara
4,874,173 A 10/1989 Kishishita
5,085,436 A 2/1992 Bennett
5,102,134 A 4/1992 Smyth
5,102,137 A 4/1992 Ekiert
5,205,555 A 4/1993 Hamano
5,209,479 A 5/1993 Nagao et al.
5,224,706 A 7/1993 Bridgeman et al.
5,332,219 A 7/1994 Marnell et al.

(Continued)

FOREIGN PATENT DOCUMENTS

AU 74936/87 6/1987
AU 199717601 9/1997

(Continued)

*Primary Examiner* — James S McClellan

(74) *Attorney, Agent, or Firm* — Neal, Gerber & Eisenberg LLP

(57) ABSTRACT

Embodiments of the present invention relate to a slot machine having a variety of methods of play to enable wild symbols to be created in the play matrix. In one embodiment, a game comprises: a plurality of reels, each of the reels including a plurality of symbol positions; a first plurality of symbols at the plurality of symbol positions on the reel, the first plurality of symbols comprising at least one designated symbol, the designated symbol having both a normal and a wild form thereof within the first plurality of symbols; a second plurality of symbols replacing a subset of the first plurality of symbols, the second plurality of symbols comprising a plurality of wild forms of the designated symbol; at least one predetermined winning symbol combination of a plurality of winning symbol combinations; and an award associated with the predetermined winning symbol combination.

18 Claims, 15 Drawing Sheets

(56) References Cited

U.S. PATENT DOCUMENTS 5,332,228 A 7/1994 Schultz
5,342,047 A 8/1994 Heidel
5,393,057 A 2/1995 Marnell et al.
5,393,061 A 2/1995 Manship et al.
5,395,111 A 3/1995 Inoue
5,449,173 A 9/1995 Thomas et al.
5,569,084 A 10/1996 Nicastro et al.
5,580,053 A 12/1996 Crouch
5,584,764 A 12/1996 Inoue
5,609,524 A 3/1997 Inoue
5,611,535 A 3/1997 Tiberio
5,697,843 A 12/1997 Manship et al.
5,704,835 A 1/1998 Dietz
5,722,891 A 3/1998 Inoue
5,743,526 A 4/1998 Inoue
5,752,881 A 5/1998 Inoue
5,766,074 A 6/1998 Cannon et al.
5,769,716 A 6/1998 Saffari et al.
5,807,172 A 9/1998 Piechowiak
5,833,537 A 11/1998 Barrie
5,848,932 A 12/1998 Adams
5,882,261 A 3/1999 Adams
5,890,962 A 4/1999 Takemoto
5,976,016 A 11/1999 Moody et al.
5,980,384 A 11/1999 Barrie
5,984,781 A 11/1999 Sunaga
5,984,782 A 11/1999 Inoue
5,997,401 A 12/1999 Crawford
6,004,207 A 12/1999 Wilson et al.
6,027,115 A 2/2000 Griswold et al.
6,033,307 A 3/2000 Vancura
6,056,642 A 5/2000 Bennett
6,059,289 A 5/2000 Vancura
6,089,978 A 7/2000 Adams
6,093,102 A 7/2000 Bennett
6,095,921 A 8/2000 Walker et al.
6,120,031 A 9/2000 Adams
6,120,378 A 9/2000 Moody et al.
6,159,096 A 12/2000 Yoseloff
6,165,070 A 12/2000 Nolte et al.
6,190,254 B1 2/2001 Bennett
6,220,959 B1 4/2001 Holmes, Jr. et al.
6,234,897 B1 5/2001 Frohm et al.
6,241,607 B1 6/2001 Payne et al.
6,261,177 B1 7/2001 Bennett
6,270,411 B1 8/2001 Gura et al.
6,290,600 B1 9/2001 Glasson
6,311,976 B1 11/2001 Yoseloff et al.
6,312,334 B1 11/2001 Yoseloff
6,315,660 B1 11/2001 DeMar et al.
6,322,078 B1 11/2001 Adams
6,328,649 B1 12/2001 Randall et al.
6,334,814 B1 1/2002 Adams
6,346,043 B1 2/2002 Colin et al.
6,358,147 B1 3/2002 Jaffe et al.
6,364,766 B1 4/2002 Anderson et al.
6,375,570 B1 4/2002 Poole
6,409,602 B1 6/2002 Wiltshire et al.
6,413,162 B1 7/2002 Baerlocher et al.
6,428,412 B1 8/2002 Anderson et al.
6,439,993 B1 8/2002 O'Halloran
6,464,582 B1 10/2002 Baerlocher et al.
6,494,454 B2 12/2002 Adams
6,517,433 B2 2/2003 Loose et al.
6,547,663 B1 4/2003 Delott et al.
6,551,187 B1 4/2003 Jaffe
6,554,703 B1 4/2003 Bussick et al.
6,554,704 B2 4/2003 Nicastro et al.
6,561,900 B1 5/2003 Baerlocher et al.
6,561,904 B2 5/2003 Locke et al.
6,565,433 B1 5/2003 Baerlocher et al.
6,569,013 B1 5/2003 Taylor
6,569,015 B1 5/2003 Baerlocher et al.
6,604,740 B1 8/2003 Singer et al.
6,616,142 B2 9/2003 Adams
6,632,139 B1 10/2003 Baerlocher
6,634,945 B2 10/2003 Glavich et al.
6,638,164 B2 10/2003 Randall et al.
6,669,559 B1 12/2003 Baerlocher et al.
6,672,960 B1 1/2004 B-Jensen
6,692,355 B2 2/2004 Baerlocher et al.
6,702,675 B2 3/2004 Poole et al.
6,719,630 B1 4/2004 Seelig et al.
6,726,563 B1 4/2004 Baerlocher et al.
6,731,313 B1 5/2004 Kaminkow
6,746,328 B2 6/2004 Cannon et al.
6,749,502 B2 6/2004 Baerlocher
6,780,109 B2 8/2004 Kaminkow
6,786,818 B1 9/2004 Rothschild et al.
6,793,577 B1 9/2004 Wilkins et al.
6,805,349 B2 10/2004 Baerlocher et al.
6,805,632 B2 10/2004 Suda
6,808,454 B2 10/2004 Gerrard et al.
6,840,858 B2 1/2005 Adams
6,855,053 B2 2/2005 Baerlocher
6,855,054 B2 2/2005 White et al.
6,857,958 B2 2/2005 Osawa
6,866,583 B2 3/2005 Glavich et al.
6,878,061 B2 4/2005 Baerlocher et al.
6,896,615 B2 5/2005 Berman
6,896,617 B2 5/2005 Daly
6,905,405 B2 6/2005 McClintic
6,905,406 B2 6/2005 Kaminkow et al.
6,918,832 B2 7/2005 Baerlocher et al.
6,921,335 B2 7/2005 Rodgers et al.
6,929,952 B2 8/2005 Baerlocher
6,939,223 B1 9/2005 Jones
6,939,229 B2 9/2005 McClintic
6,960,133 B1 11/2005 Marks et al.
6,964,416 B2 11/2005 McClintic et al.
6,971,954 B2 12/2005 Randall
6,981,635 B1 1/2006 Hughs-Baird et al.
6,988,947 B2 1/2006 Baerlocher et al.
6,997,808 B2 2/2006 Rodgers et al.
7,001,274 B2 2/2006 Baerlocher et al.
7,007,953 B1 3/2006 Cabot
7,014,560 B2 3/2006 Glavich et al.
7,040,983 B2 5/2006 Dolloff et al.
7,056,209 B2 6/2006 Baerlocher et al.
7,056,213 B2 6/2006 Ching et al.
7,059,967 B2 6/2006 Baerlocher
7,070,502 B1 7/2006 Bussick et al.
7,074,127 B2 7/2006 Cuddy et al.
7,090,580 B2 8/2006 Rodgers et al.
7,094,148 B2 8/2006 Baerlocher et al.
7,128,646 B2 10/2006 Baerlocher et al.
7,137,888 B2 11/2006 Glavich et al.
7,169,042 B2 1/2007 Muir et al.
7,229,350 B2 6/2007 Baerlocher et al.
7,258,611 B2 8/2007 Bigelow, Jr. et al.
7,281,977 B2 10/2007 Jones
7,294,055 B2 11/2007 Baerlocher et al.
7,331,862 B2 2/2008 Rodgers et al.
7,331,866 B2 2/2008 Rodgers et al.
7,341,512 B2 3/2008 Dolloff et al.
7,371,168 B2 5/2008 Bilyeu et al.
7,371,170 B2 5/2008 Cregan et al.
7,381,134 B2 6/2008 Cuddy et al.
7,387,570 B2 6/2008 Randall
7,396,279 B2 7/2008 Berman et al.
7,399,226 B2 7/2008 Mishra
7,402,102 B2 7/2008 Marks et al.
7,448,948 B2 11/2008 Hughs-Baird et al.
7,494,412 B2 2/2009 Baerlocher
7,526,736 B2 4/2009 Kaminkow et al.
7,578,737 B2 8/2009 Cregan et al.
7,578,738 B2 8/2009 Cregan et al.
7,585,219 B2 9/2009 Randall et al.
7,591,724 B2 9/2009 Baerlocher
7,666,085 B2 2/2010 Vorias et al.
7,674,173 B2 3/2010 Bennett
7,695,363 B2 4/2010 Gilliland et al.
7,699,696 B2 4/2010 Baerlocher et al.
7,727,061 B2 6/2010 Taylor

(56) References Cited

U.S. PATENT DOCUMENTS

| | | | | |
|---|---|---|---|---|
| 7,740,536 | B2 | 6/2010 | Pederson et al. | |
| 7,775,874 | B2 | 8/2010 | Ching et al. | |
| 7,789,751 | B2 | 9/2010 | Glavich et al. | |
| 7,850,521 | B2 | 12/2010 | Rodgers et al. | |
| 7,922,573 | B2 | 4/2011 | Baerlocher et al. | |
| 8,002,625 | B2 | 8/2011 | Maya | |
| 8,007,357 | B2 | 8/2011 | Cuddy et al. | |
| 8,012,011 | B2 | 9/2011 | Baerlocher et al. | |
| 8,021,226 | B2 | 9/2011 | Souza et al. | |
| 8,096,877 | B2 | 1/2012 | Hoffman | |
| 8,137,179 | B2 | 3/2012 | Jensen et al. | |
| 8,172,665 | B2 | 5/2012 | Hoffman et al. | |
| 8,221,218 | B2 | 7/2012 | Gilliland et al. | |
| 8,226,468 | B2 | 7/2012 | Hoffman et al. | |
| 8,317,597 | B2 | 11/2012 | Taylor | |
| 8,333,649 | B2 | 12/2012 | Marks et al. | |
| 8,360,851 | B2 | 1/2013 | Aoki et al. | |
| 8,382,574 | B2 | 2/2013 | Marks et al. | |
| 8,430,737 | B2 | 4/2013 | Saunders | |
| 8,430,739 | B2 | 4/2013 | Rodgers | |
| 8,678,908 | B2 | 3/2014 | Nicely | |
| 2002/0039920 | A1 | 4/2002 | Bryant | |
| 2002/0052233 | A1 | 5/2002 | Gauselmann | |
| 2002/0058545 | A1 | 5/2002 | Luciano | |
| 2002/0094857 | A1 | 7/2002 | Meyer | |
| 2003/0045345 | A1 | 3/2003 | Berman | |
| 2003/0045354 | A1 | 3/2003 | Giobbi | |
| 2003/0060267 | A1 | 3/2003 | Glavich et al. | |
| 2003/0064768 | A1 | 4/2003 | Fier | |
| 2003/0125105 | A1 | 7/2003 | Bennett | |
| 2003/0162585 | A1 | 8/2003 | Bigelow, Jr. et al. | |
| 2003/0190945 | A1 | 10/2003 | Bussick et al. | |
| 2003/0203753 | A1 | 10/2003 | Muir et al. | |
| 2003/0216165 | A1 | 11/2003 | Singer et al. | |
| 2004/0009803 | A1 | 1/2004 | Bennett et al. | |
| 2004/0023714 | A1 | 2/2004 | Asdale | |
| 2004/0048650 | A1 | 3/2004 | Mierau et al. | |
| 2004/0048651 | A1 | 3/2004 | Vorias et al. | |
| 2004/0053677 | A1 | 3/2004 | Hughs-Baird | |
| 2004/0058727 | A1 | 3/2004 | Marks et al. | |
| 2004/0067790 | A1 | 4/2004 | Peterson et al. | |
| 2004/0077396 | A1 | 4/2004 | Poole et al. | |
| 2004/0121838 | A1 | 6/2004 | Hughs-Baird et al. | |
| 2004/0171416 | A1 | 9/2004 | Baerlocher et al. | |
| 2004/0171420 | A1 | 9/2004 | Baerlocher et al. | |
| 2004/0185928 | A1 | 9/2004 | Baerlocher et al. | |
| 2004/0192431 | A1 | 9/2004 | Singer et al. | |
| 2004/0195773 | A1 | 10/2004 | Masci et al. | |
| 2004/0242313 | A1 | 12/2004 | Munoz | |
| 2004/0242316 | A1 | 12/2004 | Oles et al. | |
| 2004/0248641 | A1 | 12/2004 | Jarvis | |
| 2004/0259628 | A1 | 12/2004 | Randall | |
| 2005/0020344 | A1 | 1/2005 | Kaminkow | |
| 2005/0037836 | A1 | 2/2005 | Gilmore et al. | |
| 2005/0043081 | A1 | 2/2005 | Baerlocher | |
| 2005/0049035 | A1 | 3/2005 | Baerlocher et al. | |
| 2005/0054418 | A1 | 3/2005 | Baerlocher | |
| 2005/0054420 | A1 | 3/2005 | Cregan et al. | |
| 2005/0054436 | A1 | 3/2005 | Frizzell et al. | |
| 2005/0059477 | A1 | 3/2005 | Baerlocher | |
| 2005/0059478 | A1 | 3/2005 | Peterson et al. | |
| 2005/0064924 | A1 | 3/2005 | Glavich et al. | |
| 2005/0071023 | A1 | 3/2005 | Gilliland et al. | |
| 2005/0096121 | A1 | 5/2005 | Gilliland et al. | |
| 2005/0148384 | A1 | 7/2005 | Marks et al. | |
| 2005/0164775 | A1* | 7/2005 | Rodgers et al. | 463/20 |
| 2005/0170876 | A1 | 8/2005 | Masci et al. | |
| 2005/0192081 | A1 | 9/2005 | Marks et al. | |
| 2005/0227754 | A1 | 10/2005 | Kaminkow et al. | |
| 2006/0019738 | A1 | 1/2006 | Baerlocher et al. | |
| 2006/0030392 | A1 | 2/2006 | Rodgers et al. | |
| 2006/0063584 | A1 | 3/2006 | Brill et al. | |
| 2006/0068875 | A1 | 3/2006 | Cregan et al. | |
| 2006/0068883 | A1 | 3/2006 | Randall et al. | |
| 2006/0073876 | A1 | 4/2006 | Cuddy | |
| 2006/0073879 | A1 | 4/2006 | Baerlocher | |
| 2006/0084492 | A1 | 4/2006 | Baerlocher et al. | |
| 2006/0084493 | A1 | 4/2006 | Pederson et al. | |
| 2006/0084494 | A1 | 4/2006 | Belger et al. | |
| 2006/0084498 | A1 | 4/2006 | Baerlocher | |
| 2006/0089191 | A1 | 4/2006 | Singer et al. | |
| 2006/0121974 | A1 | 6/2006 | Rodgers et al. | |
| 2006/0172795 | A1 | 8/2006 | Bussick et al. | |
| 2006/0189364 | A1 | 8/2006 | Baerlocher | |
| 2006/0199636 | A1 | 9/2006 | Ching et al. | |
| 2006/0199637 | A1 | 9/2006 | Ching et al. | |
| 2006/0205465 | A1 | 9/2006 | Dolloff et al. | |
| 2007/0004489 | A1 | 1/2007 | Rodgers et al. | |
| 2007/0010316 | A1 | 1/2007 | Baerlocher et al. | |
| 2007/0021176 | A1 | 1/2007 | Jackson | |
| 2007/0060245 | A1* | 3/2007 | Veenker | 463/16 |
| 2007/0060248 | A1 | 3/2007 | Rodgers et al. | |
| 2007/0060255 | A1 | 3/2007 | Baerlocher et al. | |
| 2007/0060274 | A1 | 3/2007 | Rowe et al. | |
| 2007/0232383 | A1* | 10/2007 | Berman | 463/20 |
| 2007/0281778 | A1 | 12/2007 | Bigelow et al. | |
| 2008/0032783 | A1 | 2/2008 | Walker et al. | |
| 2008/0045323 | A1 | 2/2008 | Berman | |
| 2008/0085759 | A1 | 4/2008 | Bilyeu et al. | |
| 2008/0108408 | A1 | 5/2008 | Wolf | |
| 2008/0113735 | A1 | 5/2008 | Maya | |
| 2008/0113739 | A1 | 5/2008 | Visser et al. | |
| 2008/0132320 | A1 | 6/2008 | Rodgers | |
| 2008/0139298 | A1 | 6/2008 | Rodgers et al. | |
| 2008/0182650 | A1 | 7/2008 | Randall et al. | |
| 2008/0194313 | A1 | 8/2008 | Walker | |
| 2008/0200237 | A1 | 8/2008 | Cuddy et al. | |
| 2008/0200238 | A1 | 8/2008 | Mishra | |
| 2008/0280673 | A1 | 11/2008 | Marks et al. | |
| 2009/0111559 | A1 | 4/2009 | Souza et al. | |
| 2009/0118004 | A1 | 5/2009 | Hoffman | |
| 2009/0124347 | A1 | 5/2009 | Rodgers et al. | |
| 2010/0029364 | A1 | 2/2010 | Zielinski | |
| 2010/0075741 | A1 | 3/2010 | Aoki et al. | |
| 2010/0120496 | A1 | 5/2010 | Hoffman et al. | |
| 2010/0120501 | A1 | 5/2010 | Hoffman et al. | |
| 2010/0120507 | A1 | 5/2010 | Rodgers et al. | |
| 2011/0086695 | A1 | 4/2011 | Evans | |
| 2011/0098098 | A1 | 4/2011 | Stewart et al. | |
| 2012/0172106 | A1 | 7/2012 | Caputo et al. | |
| 2013/0053122 | A1 | 2/2013 | Spark-Stahl et al. | |
| 2013/0053128 | A1 | 2/2013 | Spark-Stahl et al. | |
| 2013/0095906 | A1 | 4/2013 | Marks et al. | |
| 2013/0217463 | A1 | 8/2013 | Hughes et al. | |
| 2013/0260855 | A1 | 10/2013 | Jackson | |

FOREIGN PATENT DOCUMENTS

| | | | |
|---|---|---|---|
| EP | 0060019 | | 9/1982 |
| EP | 0410789 | | 1/1991 |
| EP | 0698869 | | 2/1996 |
| EP | 0984408 | | 3/2000 |
| EP | 1205984 | | 10/2001 |
| GB | 2106292 | | 4/1983 |
| GB | 2316214 | | 2/1998 |
| WO | WO 97/32285 | A1 | 9/1997 |
| WO | WO00/66235 | | 11/2000 |
| WO | WO00/76606 | | 12/2000 |
| WO | WO 2005/009560 | A2 | 2/2005 |
| WO | WO 2007/084766 | | 7/2007 |

* cited by examiner

GAMING DEVICE HAVING WILD SYMBOL GENERATION WITHIN A PLAY MATRIX

CROSS-REFERENCE TO RELATED APPLICATIONS

This application claims priority to U.S. Provisional Patent Application Ser. No. 61/522,113, filed Aug. 10, 2011, and titled "Gaming Device Having Wild Symbol Generation within a Play Matrix," the disclosure of which is incorporated herein by reference in its entirety.

BACKGROUND

1. Field of the Invention

Embodiments of the present invention generally relate to a gaming device having wild symbol generation within a play matrix. More specifically, embodiments of the present invention relate to a slot machine having a variety of methods of play to enable wild symbols to be created in the play matrix.

2. Description of Related Art

To play a conventional slot machine, a player deposits money in the form of coins, gaming tokens or paper currency either into a coin head or bill acceptor. The coins and gaming tokens are collected in a reservoir inside the gaming machine while the paper currency is collected in the bill acceptor inside the gaming machine. If the coins, gaming tokens or paper currency are validated as authentic, the player accrues the appropriate number of playing credits on a credit meter. For example, a twenty-five cent gaming machine will accrue four credits for each dollar deposited into the gaming machine.

After accruing credits on the credit meter, the player determines how many credits he wishes to wager on the next spin of the slot reels. After setting the wager, the player spins the reels by pressing the spin button or by pulling a handle. When the reels stop spinning, symbols are displayed on the slot reels. The player then collects credits for winning combinations, if any, according to a pay table. More specifically, the slot machine operates as follows:

Symbol Matrix.

Slot symbols are displayed on 3 or more slot reels (also called "columns") placed adjacent to each other. Each column contains at least 3 rows, with a symbol in each row. The resulting matrix of symbols typically ranges from 3 columns by 3 rows with 9 total symbols to 5 columns by 3 rows with 15 total symbols. Within the symbol matrix, positions on the slot reels may be referred to according to column, from left to right, and row, from the top to bottom ("symbol positions"). For example: symbol position 1/2 is located in column 1 (i.e., left-most column) and row 2 (i.e., middle row).

Winning Combinations.

Players collect credits for predetermined winning symbol combinations that appear in specific positions ("pay lines") on the slot reels. Winning combinations typically require that three or more of the same symbols appear adjacent to each other starting from the leftmost position of a pay line ("line pays"). For example: a player may collect a line pay if 3 Banana symbols appeared in symbol positions 1/1, 2/1, 3/1 on a pay line using symbol positions 1/1, 2/1, 3/1, 4/1, and 5/1.

Players may also collect credits for predetermined winning combinations that appear anywhere on a pay line ("line scatter pays") or anywhere on the slot reels ("reel scatter pays"). For example, a player may collect a line scatter pay if 3 Banana symbols appeared in symbol positions 1/1, 3/1, 5/1 on a pay line using symbol positions 1/1, 2/1, 3/1, 4/1, and 5/1; and collect a reel scatter pay if 3 Banana symbols appeared anywhere on the slot reels.

Pay Table.

Credits are awarded to the player for each winning symbol combination based on a predetermined schedule. For line pays and line scatter pays, the number of credits wagered on the winning pay line multiplies the number of credits indicated by the pay table. For example, a player may wager two credits each on five pay lines, spin the reels, and collect twice the amount indicated on the pay table for a line pay or line scatter pay appearing on any of the five played pay lines. For reel scatter pays, the total number of credits wagered multiplies the number of credits indicated by the pay table. For example, a player may wager ten total credits, spin the reels, and collect ten times the amount indicated on the pay table for a reel scatter pay appearing on anywhere on the slot reels.

Following any type of pay (e.g., line pays, line scatter pays, or reel scatter pays), credits won are added to the player's credit balance shown on the credit meter. As long as the player has credits on the credit meter, the player may continue to play the game. Following any spin, the player may collect the credit balance by pressing the Cash Out button.

While the above elements are common to many slot machine games, without more, players are often easily bored by simple conventional game play. Therefore, there is a need for a gaming apparatus having an improved game play to attract more players.

SUMMARY

Embodiments of the present invention generally relate to a gaming device having wild symbol generation within a play matrix. More specifically, embodiments of the present invention relate to a slot machine having a variety of methods of play to enable wild symbols to be created in the play matrix.

In one embodiment of the present invention, a game device comprises: a display device; an input device; and a processor for accessing a plurality of instructions which, when executed by the processor, cause the processor to operate with the display device and the input device to: provide a game comprising: a plurality of reels, each of the reels including a plurality of symbol positions; a first plurality of symbols at the plurality of symbol positions on the reel, the first plurality of symbols comprising at least one designated symbol, the designated symbol having both a normal and a wild form thereof within the first plurality of symbols; a second plurality of symbols replacing a subset of the first plurality of symbols, the second plurality of symbols comprising a plurality of wild forms of the designated symbol; at least one predetermined winning symbol combination of a plurality of winning symbol combinations; and an award associated with the predetermined winning symbol combination.

In another embodiment of the present invention, a game device comprises: a display device; an input device; and a processor for accessing a plurality of instructions which, when executed by the processor, cause the processor to operate with the display device and the input device to: provide a game comprising: a plurality of reels, each of the reels including a plurality of symbol positions; a first plurality of symbols at the plurality of symbol positions on the reel, the first plurality of symbols comprising at least one predetermined activator symbol; a second plurality of symbols activated by the activator symbol, the second plurality of symbols replacing a subset of the first plurality of symbols, the second plurality of symbols comprising a plurality of wild symbols; at least one predetermined winning symbol combination of a plurality of winning symbol combinations; and an award associated with the predetermined winning symbol combination; wherein the second plurality of symbols are located at predetermined symbol positions relative to the predetermined activator symbol.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1A:
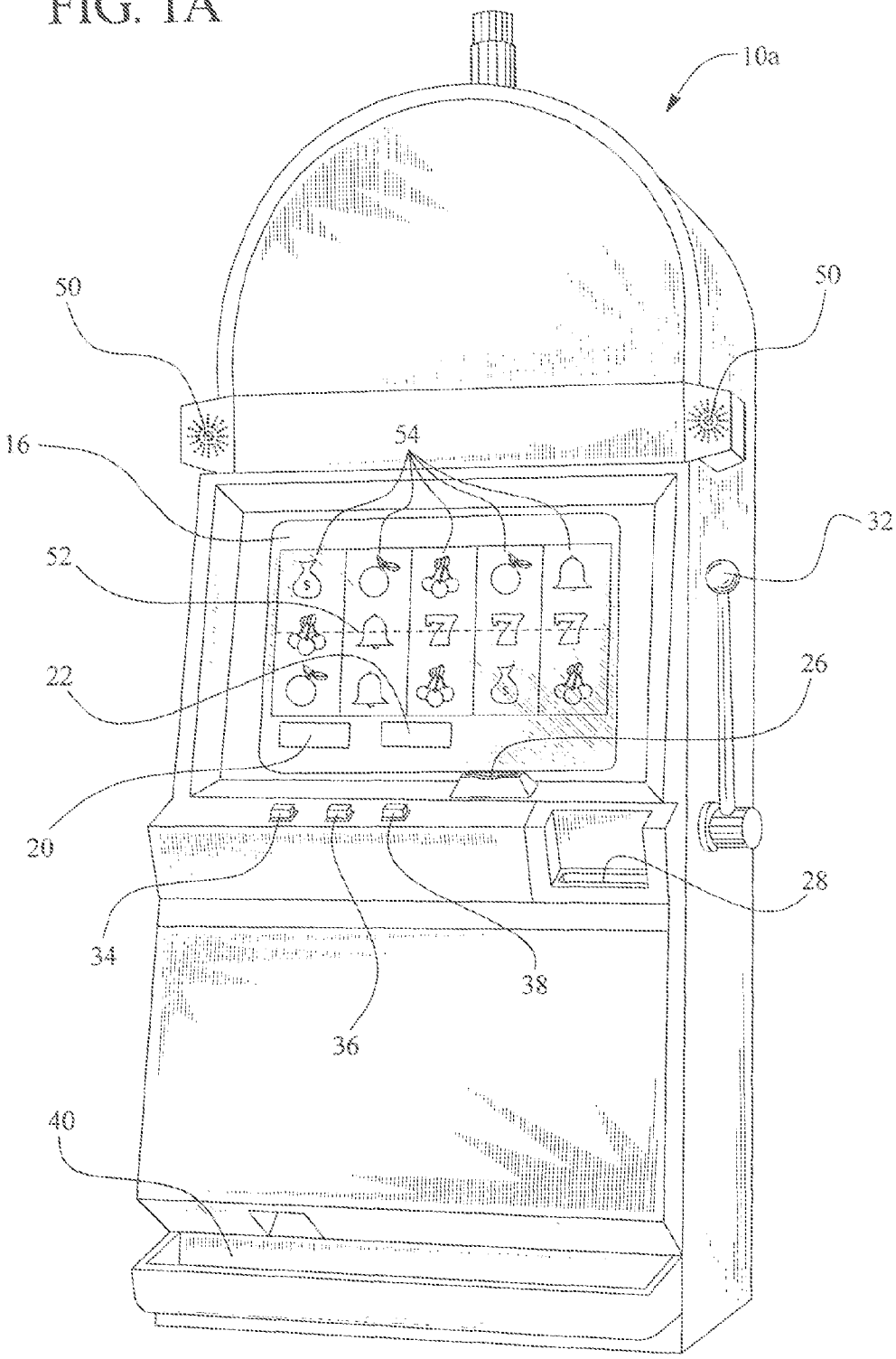
FIG. 1A depicts a front perspective view of a gaming device in the form of a slot machine in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

In the following detailed description, numerous specific details are set forth in order to provide a thorough understanding of exemplary embodiments or other examples described herein. However, it will be understood that these examples may be practiced without the specific details. In other instances, well-known methods, procedures, and components have not been described in detail, so as to not obscure the following description. Furthermore, the examples disclosed herein are for exemplary purposes only and other examples may be employed in lieu of, or in combination with, the examples disclosed.

Embodiments of the present invention generally relate to a gaming device having wild symbol generation within a play matrix. More specifically, embodiments of the present invention relate to a slot machine having a variety of methods of play to enable wild symbols to be created in the play matrix.

Figure 1B:
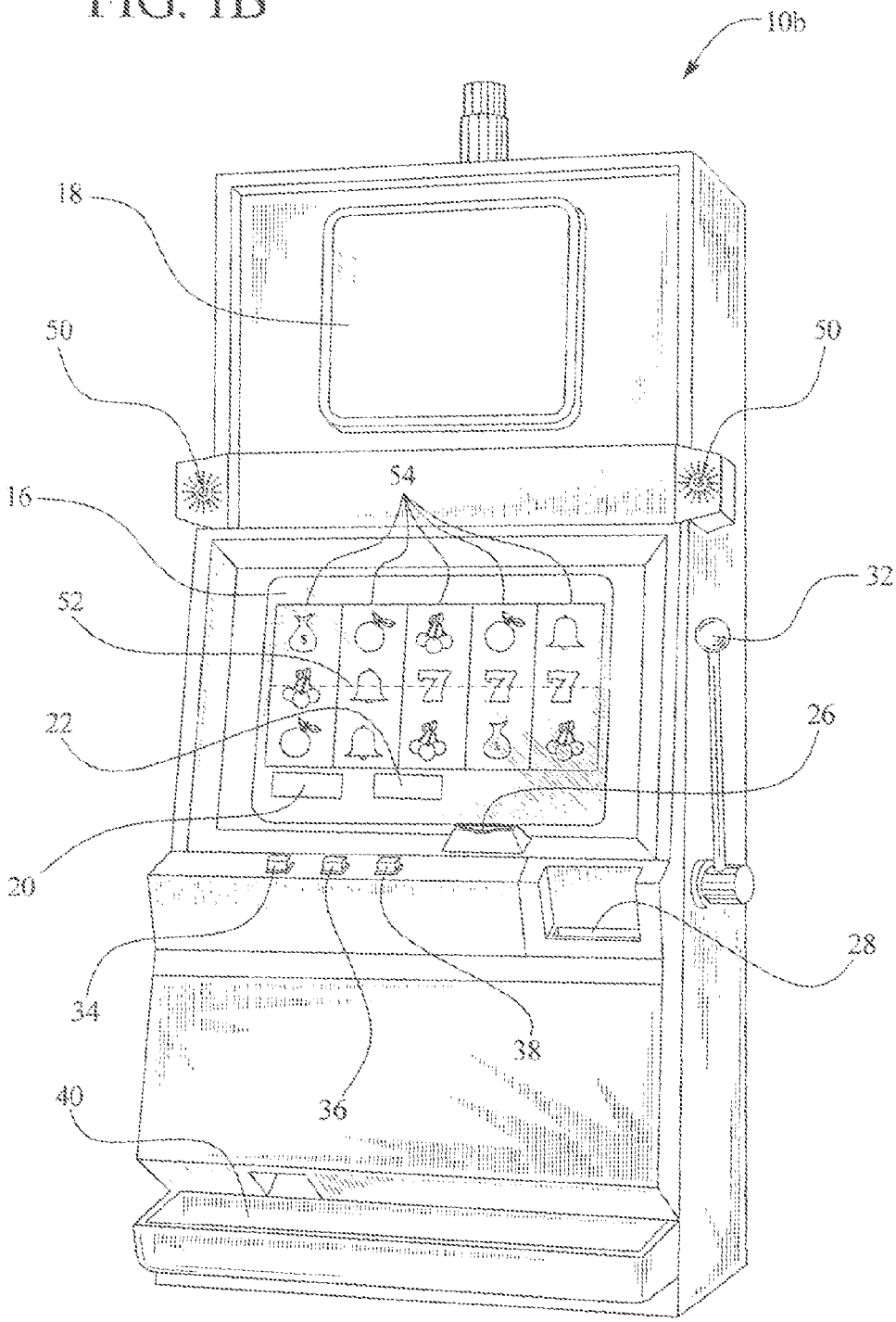
FIG. 1B depicts a front perspective view of a gaming device in the form of a slot machine in accordance with another embodiment of the present invention.

Two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 1C:
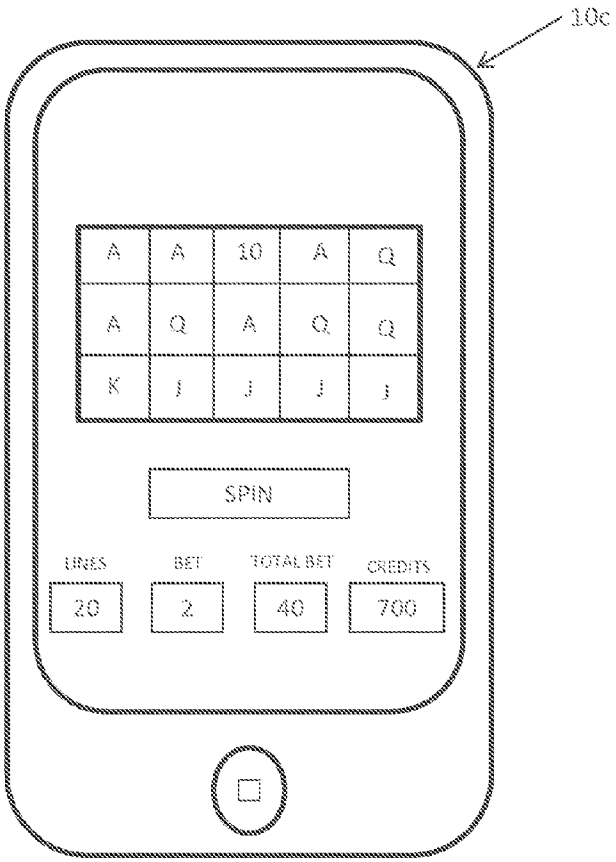
FIG. 1C depicts a front perspective view of a gaming device in the form of a mobile device in accordance with one embodiment of the present invention.
Figure 1D:
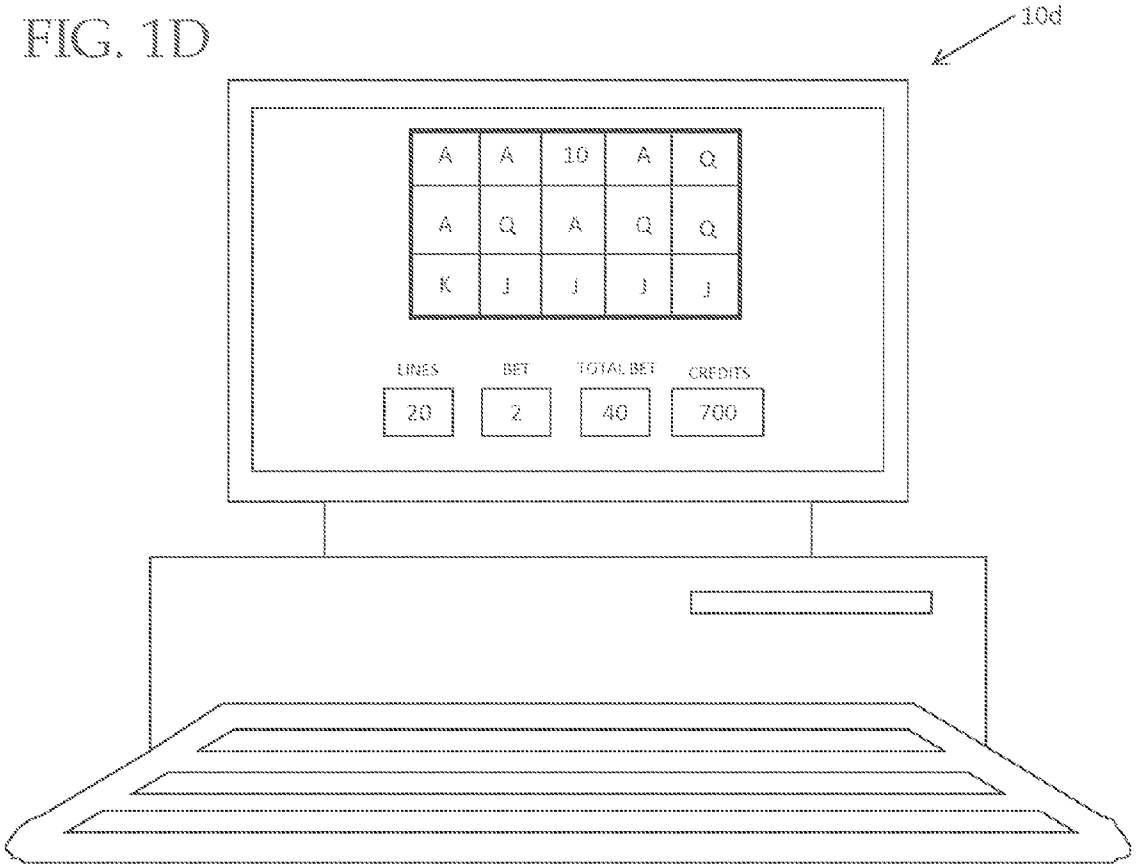
FIG. 1D depicts a front perspective view of a gaming device in the form of a personal computer in accordance with one embodiment of the present invention.
Figure 2A:
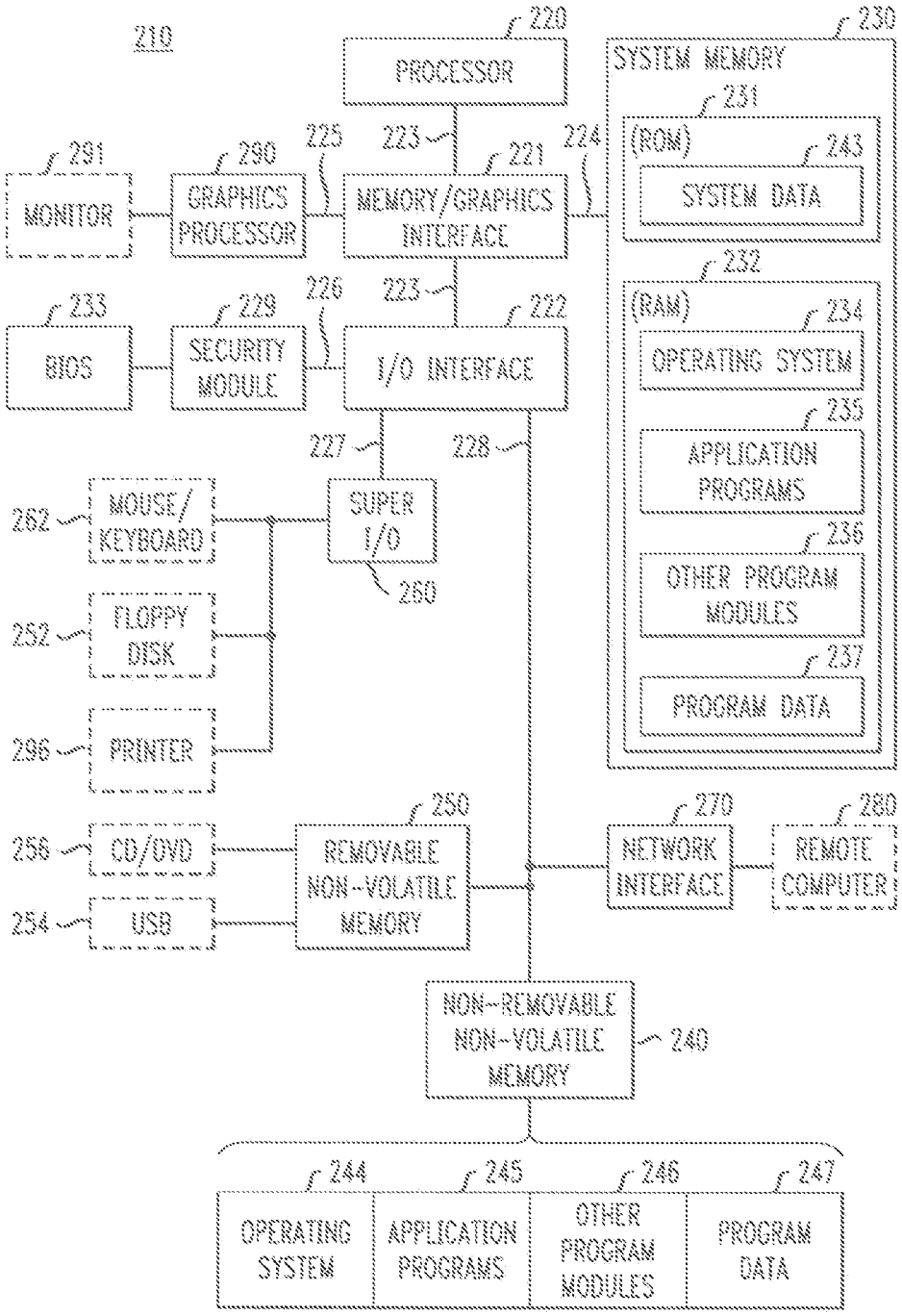
FIG. 2A depicts a schematic block diagram of a general purpose computer system, which may be used with any of the gaming devices of FIGS. 1A-1D, in accordance with embodiments of the present invention.

In several embodiments, the electronic gaming devices, for example, as shown in FIGS. 1A-1D, may comprise all or part of a general purpose computer system, for example, the general purpose computer system of FIG. 2. It should be appreciated, however, the general purpose computing system of FIG. 2 is merely an exemplary embodiment of an electronic device, and actual electronic devices may comprise any one or more components shown in FIG. 2A, suitable for embodiments of the present invention.

With reference to FIG. 2A, a general purpose computer system in the form of a computer 210 is shown. As understood by embodiments of the present invention, components shown in dashed outline are not part of the computer 210, but are used to illustrate the exemplary embodiment of FIG. 2A. Components of computer 210 may include, but are not limited to, a processor 220, a system memory 230, a memory/graphics interface 221, also known as a Northbridge chip, and an I/O interface 222, also known as a Southbridge chip. The system memory 230 and a graphics processor 290 may be coupled to the memory/graphics interface 221. A monitor 291 or other graphic output device may be coupled to the graphics processor 290.

A series of system busses may couple various system components including a high speed system bus 223 between the processor 220, the memory/graphics interface 221 and the I/O interface 222, a front-side bus 224 between the memory/graphics interface 221 and the system memory 230, and an advanced graphics processing (AGP) bus 225 between the memory/graphics interface 221 and the graphics processor 290. The system bus 223 may be any of several types of bus structures including, by way of example, and not limitation, such architectures include Industry Standard Architecture (ISA) bus, Micro Channel Architecture (MCA) bus and Enhanced ISA (EISA) bus. As system architectures evolve, other bus architectures and chip sets may be used but often generally follow this pattern. For example, companies such as Intel and AMD support the Intel Hub Architecture (IHA) and the Hypertransport architecture, respectively.

The computer 210 typically includes a variety of computer readable media. Computer readable media can be any available media that can be accessed by computer 210 and includes both volatile and nonvolatile media, removable and non-removable media. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium that can be used to store the desired information and can accessed by the computer 210.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory 230 includes computer storage media in the form of volatile and/or nonvolatile memory such as read only memory (ROM) 231 and random access memory (RAM) 232. The system ROM 231 may contain permanent system data 243, such as identifying and manufacturing information. In some embodiments, a basic input/output system (BIOS) may also be stored in system ROM 231. RAM 232 typically contains data and/or program modules that are immediately accessible to and/or presently being operated on by processor 220. By way of example, and not limitation, FIG. 2 illustrates operating system 234, application programs 235, other program modules 236, and program data 237.

The I/O interface 222 may couple the system bus 223 with a number of other buses 226, 227 and 228 that couple a variety of internal and external devices to the computer 210. A serial peripheral interface (SPI) bus 226 may connect to a BIOS memory 233 containing the basic routines that help to transfer information between elements within computer 210, such as during start-up.

In some embodiments, a security module 229 may be incorporated to manage receipt of money/credits, issuance of money/credits, and enforcement of policies, as may be required in the gaming industry. In many embodiments, such security module 229 may be coupled with a payment acceptor built into a physical machine. A payment acceptor may include a coin slot and a payment, note or bill acceptor, where the player inserts money, coins or tokens. For example, the player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

A super input/output chip 260 may be used to connect to a number of 'legacy' peripherals, such as floppy disk 252, keyboard/mouse/buttons 262, and printer 296, as examples. The super I/O chip 260 may be connected to the I/O interface 222 with a low pin count (LPC) bus, in some embodiments. The super I/O chip 260 is widely available in the commercial marketplace.

In one embodiment, bus 228 may be a Peripheral Component Interconnect (PCI) bus, or a variation thereof, may be used to connect higher speed peripherals to the I/O interface 222. A PCI bus may also be known as a Mezzanine bus. Variations of the PCI bus include the Peripheral Component Interconnect-Express (PCI-E) and the Peripheral Component Interconnect-Extended (PCI-X) busses, the former having a serial interface and the latter being a backward compatible parallel interface. In other embodiments, bus 228 may be an advanced technology attachment (ATA) bus, in the form of a serial ATA bus (SATA) or parallel ATA (PATA).

The computer 210 may also include other removable/non-removable, volatile/nonvolatile computer storage media. By way of example only, FIG. 2A illustrates a hard disk drive 240 that reads from or writes to non-removable, nonvolatile magnetic media. Removable media, such as a universal serial bus (USB) memory 252 or CD/DVD drive 256 may be connected to the PCI bus 228 directly or through an interface 250. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like.

The drives and their associated computer storage media, discussed above and illustrated in FIG. 2A, provide storage of computer readable instructions, data structures, program modules and other data for the computer 210. In FIG. 2A, for example, hard disk drive 240 is illustrated as storing operating system 244, application programs 245, other program modules 246, and program data 247. Note that these components can either be the same as or different from operating system 234, application programs 235, other program modules 236, and program data 237. Operating system 244, application programs 245, other program modules 246, and program data 247 are given different numbers here to illustrate that, at a minimum, they are different elements within the computer 210. A user may enter commands and information into the computer 210 through input devices such as a mouse/keyboard 262 or other input device combination. Other input devices (not shown) may include a microphone, joystick, game pad, satellite dish, scanner, or the like. These and other input devices are often connected to the processor 220 through one of the I/O interface busses, such as the SPI 226, the LPC 227, or the PCI 228, but other busses may be used. In some embodiments, other devices may be coupled to parallel ports, infrared interfaces, game ports, and the like (not depicted), via the super I/O chip 260.

The computer 210 may operate in a networked environment using logical connections to one or more remote computers, such as a remote computer 280 via a network interface controller (NIC) 270. The remote computer 280 may be a personal computer, a server, a router, a network PC, a peer device or other common network node, and typically includes many or all of the elements described above relative to the computer 210. The logical connection between the NIC 270 and the remote computer 280 depicted in FIG. 2 may include a local area network (LAN), an Ethernet-based network, a wide area network (WAN), or both, but may also include other networks. Such networking environments are commonplace in offices, enterprise-wide computer networks, intranets, and the Internet.

Returning to FIGS. 1A-1D, in one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

As shown by FIGS. 1A and 1B, and supported by the elements depicted in FIG. 2A, many embodiments of the present invention comprise at least one, and often a plurality, of input devices in communication with the processor. The input devices can include any suitable device which enables the player to produce an input signal which is read by the processor, for instructing the game and/or gaming device to do something. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, one input device is a touch-screen coupled with a touch-screen controller, or some other touch-sensitive display overlay to allow for player interaction with the images on the display. The touch-screen and the touch-screen controller are connected to a video controller. A player can make decisions and input signals into the gaming device by touching touch-screen at the appropriate places.

In one embodiment, the gaming device includes a sound generating device controlled by one or more sound cards which function in conjunction with the processor. In one embodiment, the sound generating device includes at least one and preferably a plurality of speakers or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Suitable gaming devices may incorporate any suitable wagering primary or base game. The gaming machine or device of embodiments of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary wagering games, such as video poker games, video blackjack games, video Keno, video bingo or any other suitable primary or base game may be implemented into an embodiment of the present invention.

In one embodiment, a base or primary game may be a slot game with one or more paylines 52. The paylines may be horizontal, vertical, circular, diagonal, angled or any combination thereof. In this embodiment, the gaming device displays at least one and preferably a plurality of reels 54, for example, having three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels 54 are in video form, the plurality of simulated video reels 54 are displayed on one or more of the display devices as described above. Each reel 54 displays a plurality of indicia such as bells, hearts, fruits, numbers, letters, bars or other images which may generally correspond to a theme associated with the gaming device. In this embodiment, the gaming device awards prizes when the reels of the primary game stop spinning if specified types and/or configurations of indicia or symbols occur on an active pay line or otherwise occur in a winning pattern.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game; he must win or earn entry through play of the primary game and, thus, play of the primary game is encouraged. In another embodiment, qualification of the bonus or secondary game could be accomplished through a simple "buy in" by the player if, for example, the player has been unsuccessful at qualifying through other specified activities.

Figure 2B:
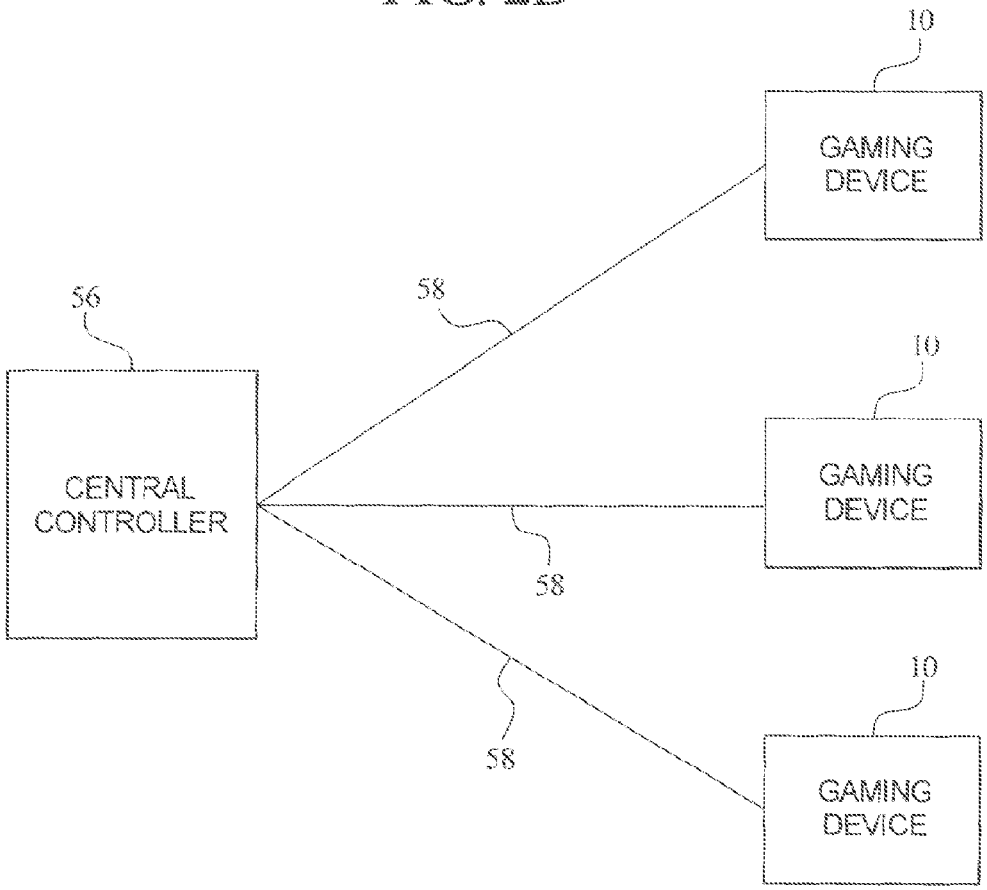
FIG. 2B depicts a schematic block diagram illustrating a plurality of gaming terminals and communication with a central controller in accordance with one embodiment of the present invention.

In one embodiment, as illustrated in FIG. 2B, one or more of the gaming devices 10 of embodiments of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of an embodiment of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is a global computer network, such as the Internet, or an intranet network, and the gaming system may be considered an online system, a mobile system, or the like. In this embodiment, the operation of the gaming device can be viewed at the gaming device with at least one web browser, or application, such that access to the data network is feasible. In this embodiment, operation of the gaming device and accumulation of credits may be accomplished with a connection to the central server or controller through a conventional phone or other data transmission line, digital signal line (DSL), T-1 line, coaxial cable, fiber optic cable, or other suitable connection. In this embodiment, players may access a game page from any location where a network connection and computer, or other gaming device 10, are available. For example, either of the gaming devices of FIGS. 1C and 1D are suitable for accessing such a data network.

The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to some embodiments of the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

In some embodiments, the data network may be integrated into an existing network platform, for example, a social networking site. For example, in one embodiment, the data network may comprise an application within a social networking site, e.g., Facebook, whereby players may access the data network via a connection to the social networking site. Such an integrated arrangement may be advantageous for applications of embodiments of the present invention that seek to have near immediate access to a significant potential customer base.

In further embodiments, the data network may be accessed via a downloadable application to a mobile device, such as a smartphone, a tablet, a mobile computer, or the like. As in known in the mobile device industry, such a downloadable application may be stored at a remote server, and upon request, a player may utilize a mobile device to download such downloadable application to be stored locally on the mobile device. Such downloadable application may access the data network through the mobile device's network connection, and provide the player a convenient means through which to access the data network. In alternative embodiments, the downloadable application may not require a network connection on a regular basis, and a game may be accessible locally on the mobile device. However, in such embodiments, some of the benefits of networked game play, such as competitions, updates, etc., may not be available until the mobile device reconnects to the data network.

Figure 3:
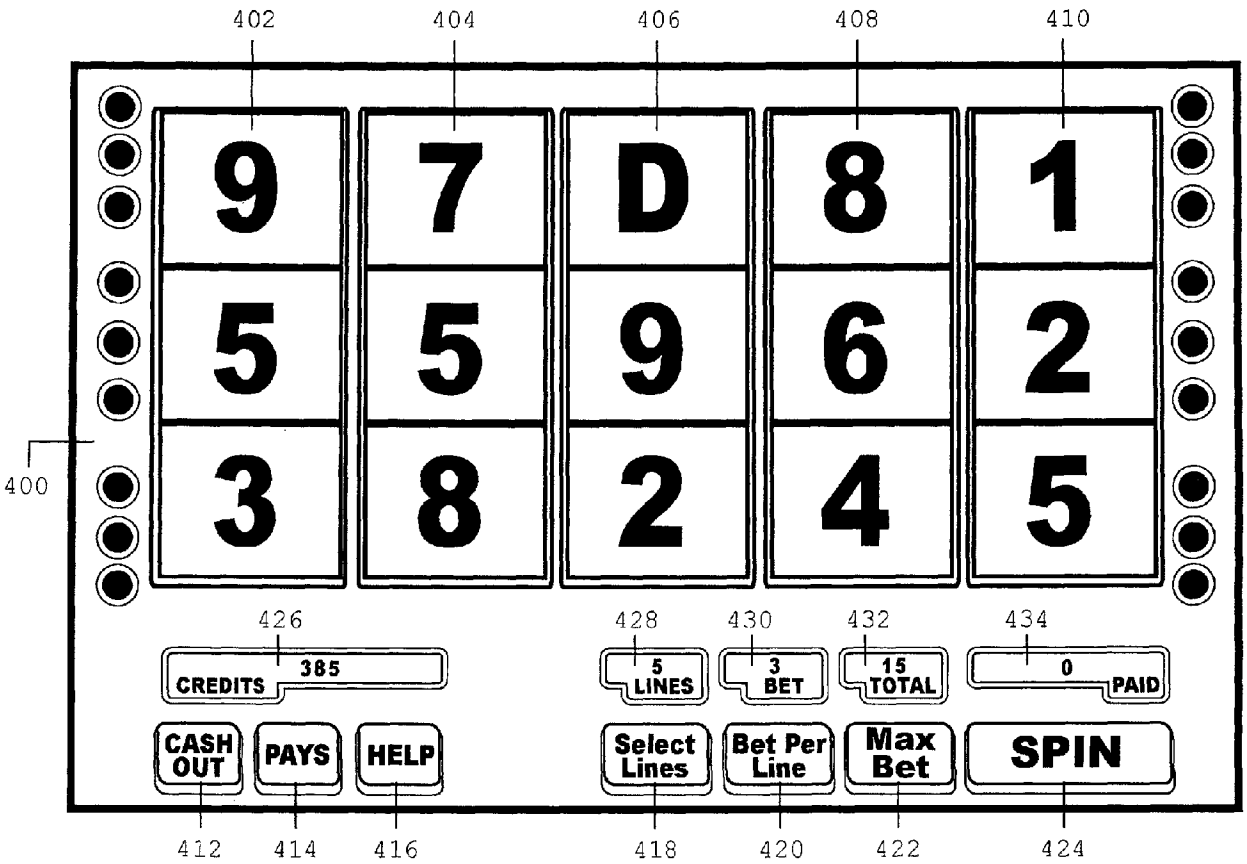
FIGS. 3-10 depict representative displays that may be encountered during a typical game in accordance with the principles of embodiments of the present invention.

FIG. 3 shows an exemplary video display 400, including a 5-column by 3-row symbol matrix, as shown on the slot reels 402-410. The first column 402, second column 404, third column 406, fourth column 408 and fifth column 410 all hold three symbols. Alternatively, the game could utilize any number of columns and reels, such as a 3-column by 3-row symbol matrix.

FIG. 3 also shows an exemplary set of control buttons 412-424 used by the player to control the functions of the slot game. These buttons may include Cash Out 412, Pay Table 414, Help 416, Select Pay Lines 418, Bet Per Line 420, Max Bet 422 and Spin 424. Any or all of these control buttons may be displayed on the video display 400 and/or buttons hard wired to the gaming device. If necessary, any number of buttons may be added or removed to further facilitate control of the games.

FIG. 3 additionally shows a set of exemplary meters 426-434 used to display the salient information for the game, including Credits 426, Number of Pay Lines 428 Amount Bet Per Line 430, Total Bet 432, and Paid 434. The Credits meter 426 displays the total number credits remaining in the credit pool. The Number of Pay Lines meter 428 is associated with the Select Pay Lines button and displays the current number of Pay Lines Selected. The Amount Bet Per Line 430 meter is associated with the Bet Per Line button 420 and displays the number of credits wagered per pay line. The Total Bet 432 meter displays the cumulative value of the Number of Pay Lines 428 and Amount Bet Per Line 430. The Paid meter 434 displays the number of credits won on the last spin.

FIG. 3 also shows an exemplary number of credits in the credit pool, as displayed on the Credits meter 426. The pool of credits increases and decreases according to the player's wins or losses and may be supplemented, if necessary, by the player by additional deposits of coins, tokens or paper currency.

FIG. 3 shows an exemplary number of pay lines upon which the player wagered, as displayed on the Number of Pay Lines meter 428. More specifically, FIG. 9 shows the location of the pay lines 502-518.

In one embodiment, the pay lines activate in a predetermined order, as follows: the first wager is applied to pay line 1 at 502; the second wager is applied to pay line 2 at 504; the third wager is applied to pay line 3 at 506; the fourth wager is applied to pay line 4 at 508; the fifth wager is applied to pay line 5 at 510; the sixth wager is applied to pay line 6 at 512; the seventh wager is applied to pay line 7 at 514; the eighth wager is applied to pay line 8 at 516; the ninth wager is applied to pay line 9 at 518. However, the games may have fewer or greater than nine pay lines and utilize any order of pay line activation.

Returning to FIG. 3, an exemplary number of credits wagered on each pay line is provided, as displayed on the Bet Per Line meter 430. Usually the same amount is wagered on each pay line. Alternatively, however, the player could be allowed to make wagers of different amounts on each pay line. The total amount wagered is determined by summing the amounts wagered on each pay line. FIG. 3 also shows the total number of credits bet on all of the pay lines, as displayed on the Total Bet meter 432. The total bet is calculated by multiplying Number of Pay Lines 428 by Bet Per Line 430.

Figure 7:
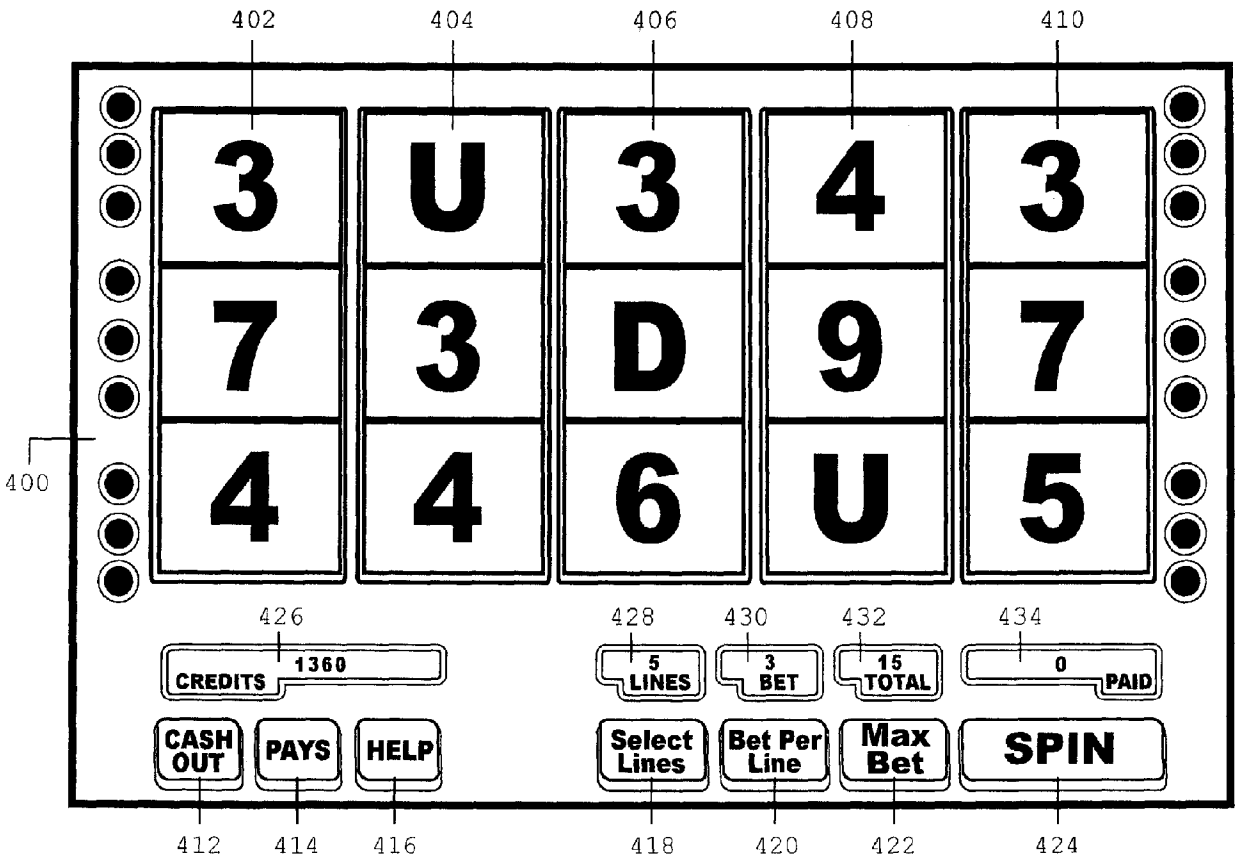
Figure 8:
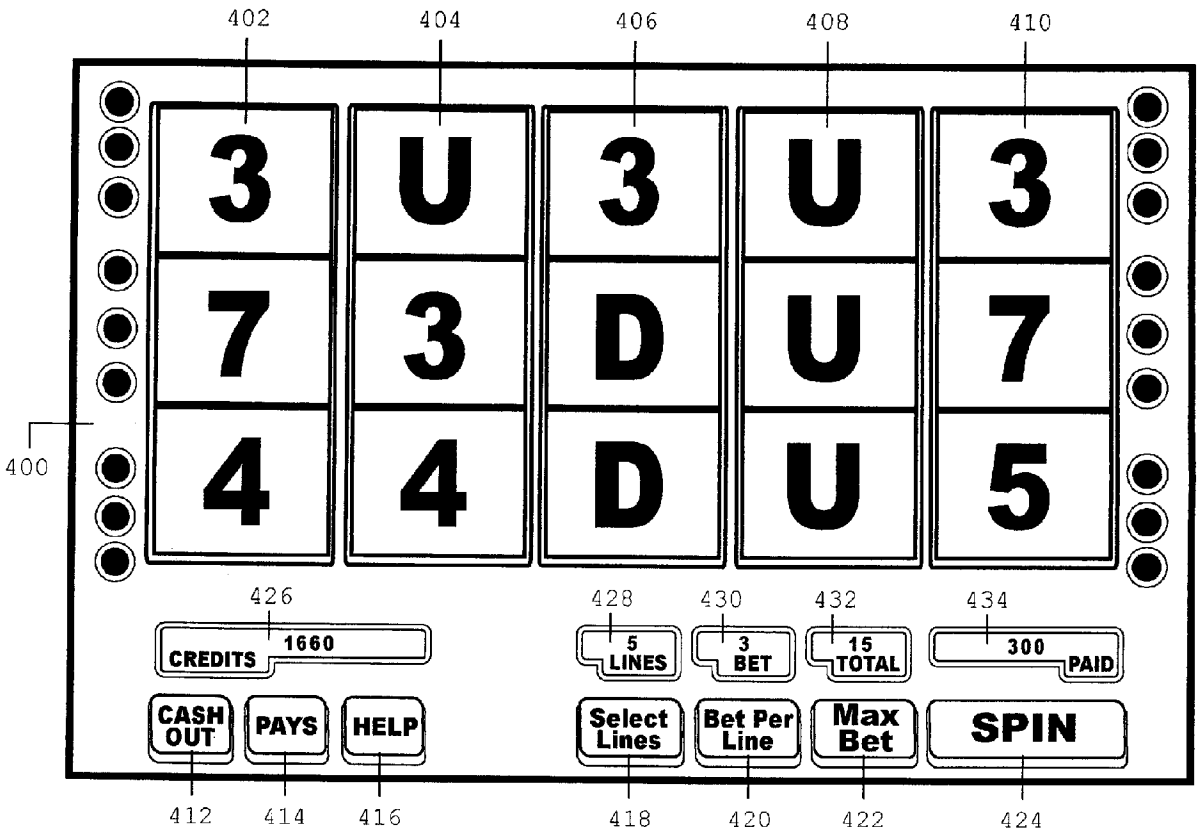
Figure 9:
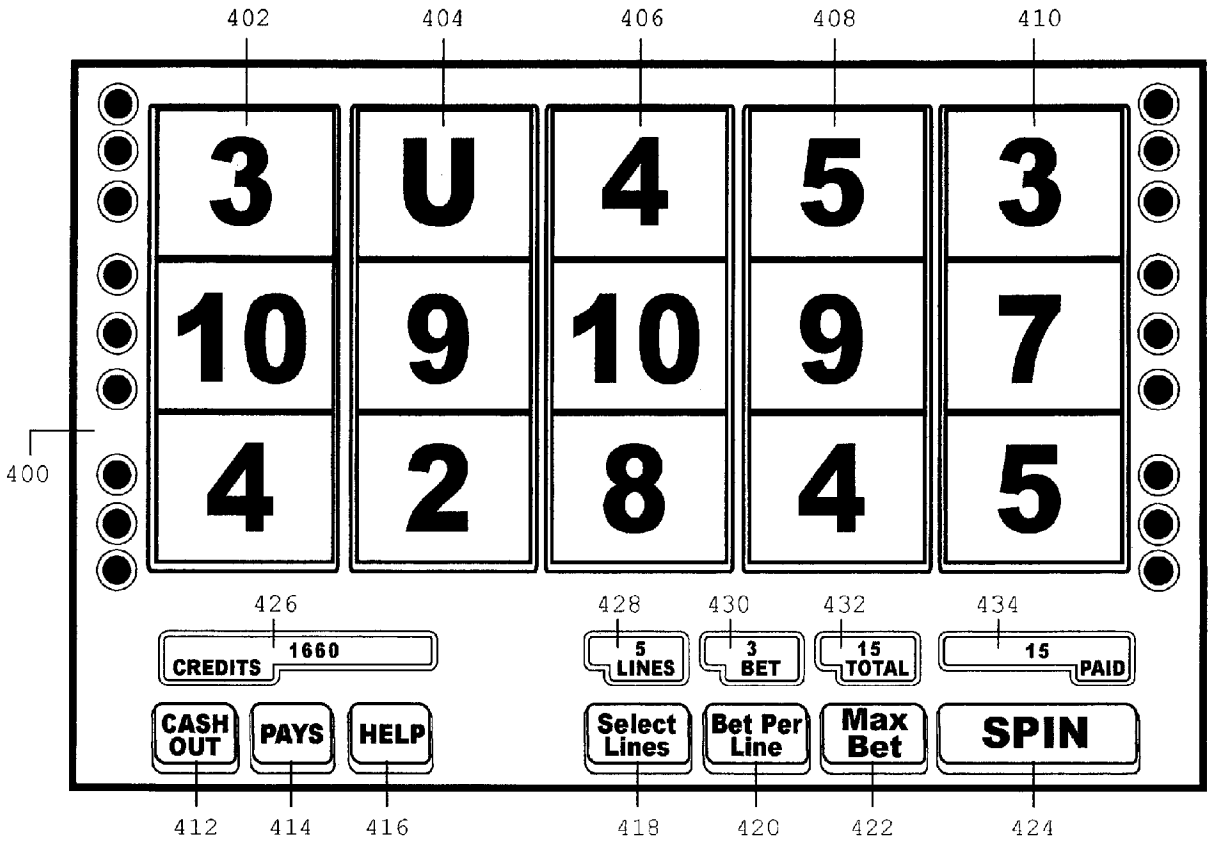
Figure 10:
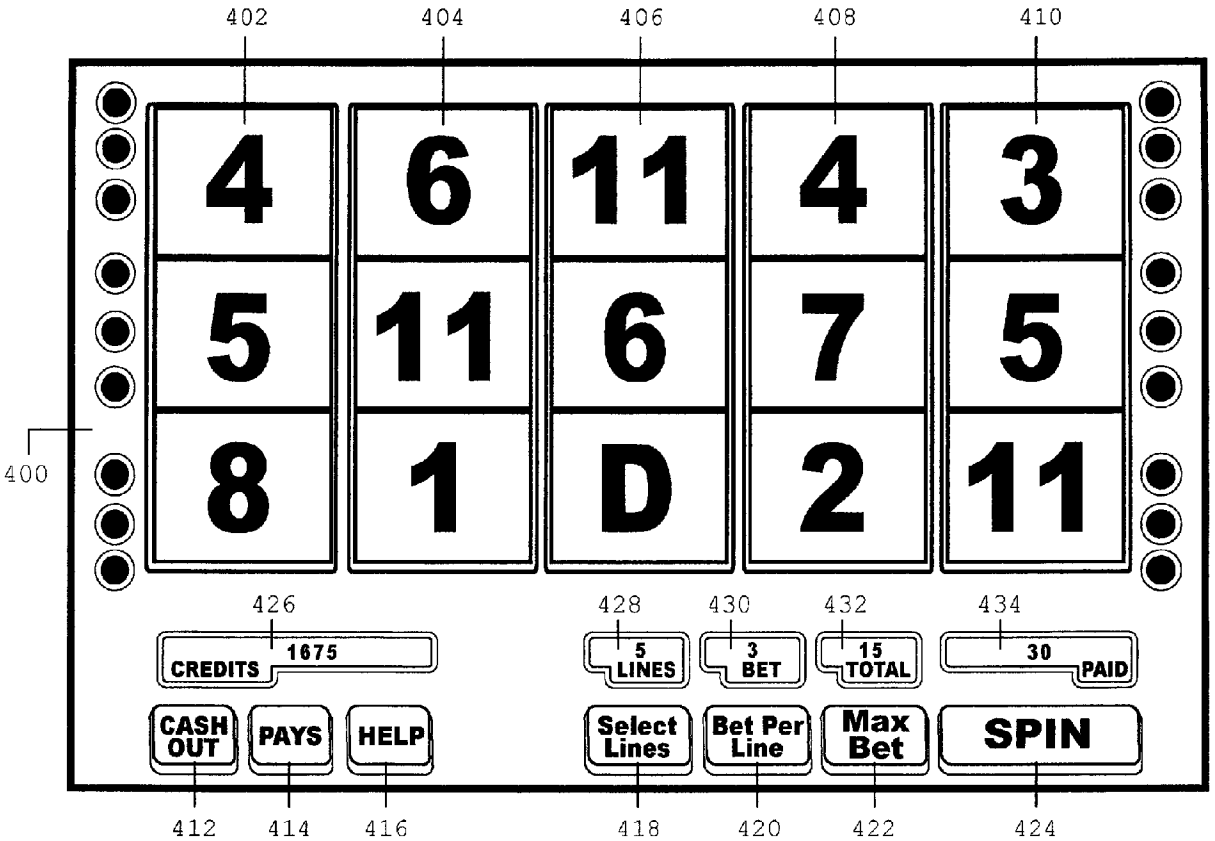

FIGS. 3-10 show an exemplary symbol set, as displayed on slot reels 402-410. As shown, each of the symbols belongs to one of three groups: base symbols, scatter symbols, and directional wild symbols. FIGS. 3-10 show base symbols 1 to 9. Base symbols provide line pays for three or more same symbols appearing adjacent to each other on an active pay line, from the leftmost pay line position towards the right. FIGS. 9 and 10 show scatter symbols 10 and 11. Scatter symbols provide scatter pays for any one or more scatter symbols appearing anywhere on a pay line (line-scatter pay; 10) or anywhere on the slot reels (reel-scatter pay; 11). FIGS. 3-8 show Directional Wild symbols U (upwards) and D (downwards). Directional Wild symbols expand in a pre-determined vertical direction in the symbol matrix. All of the resulting wild symbols act as any base symbol to help form winning combinations on active pay lines.

Figure 4:
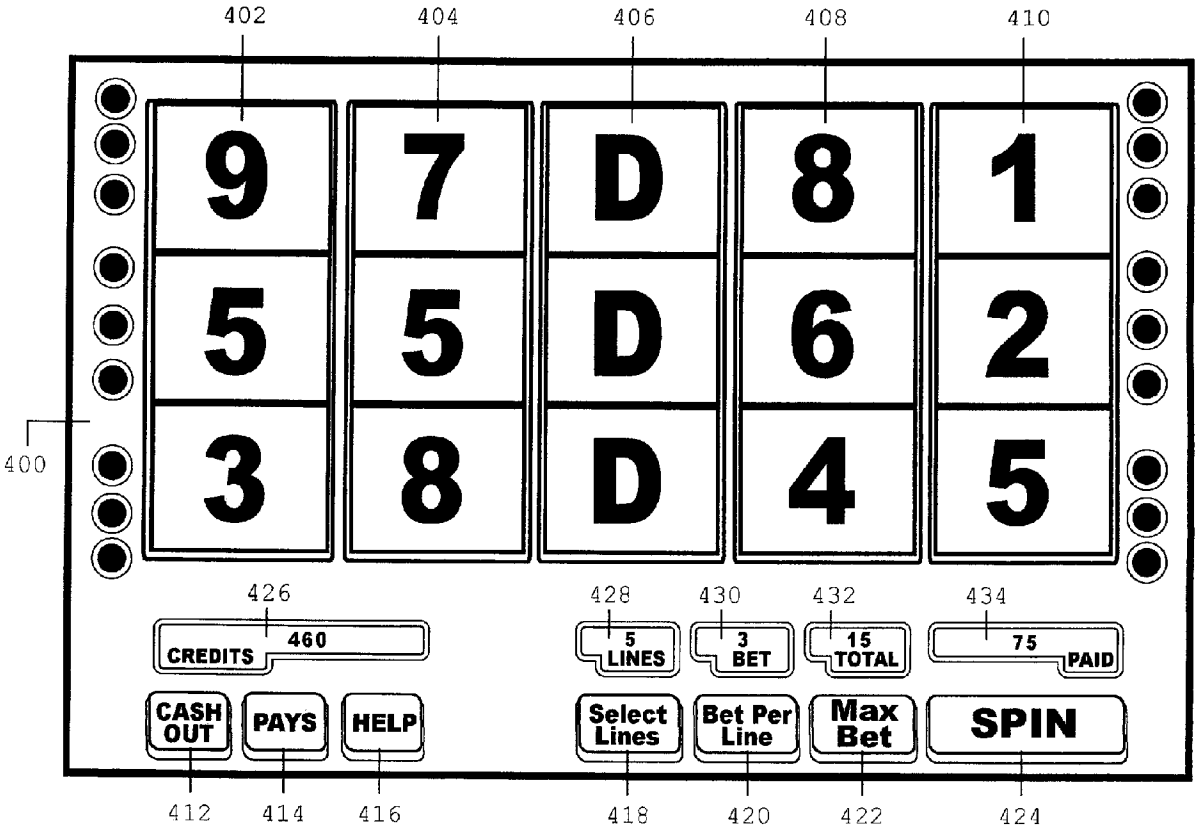
Figure 5:
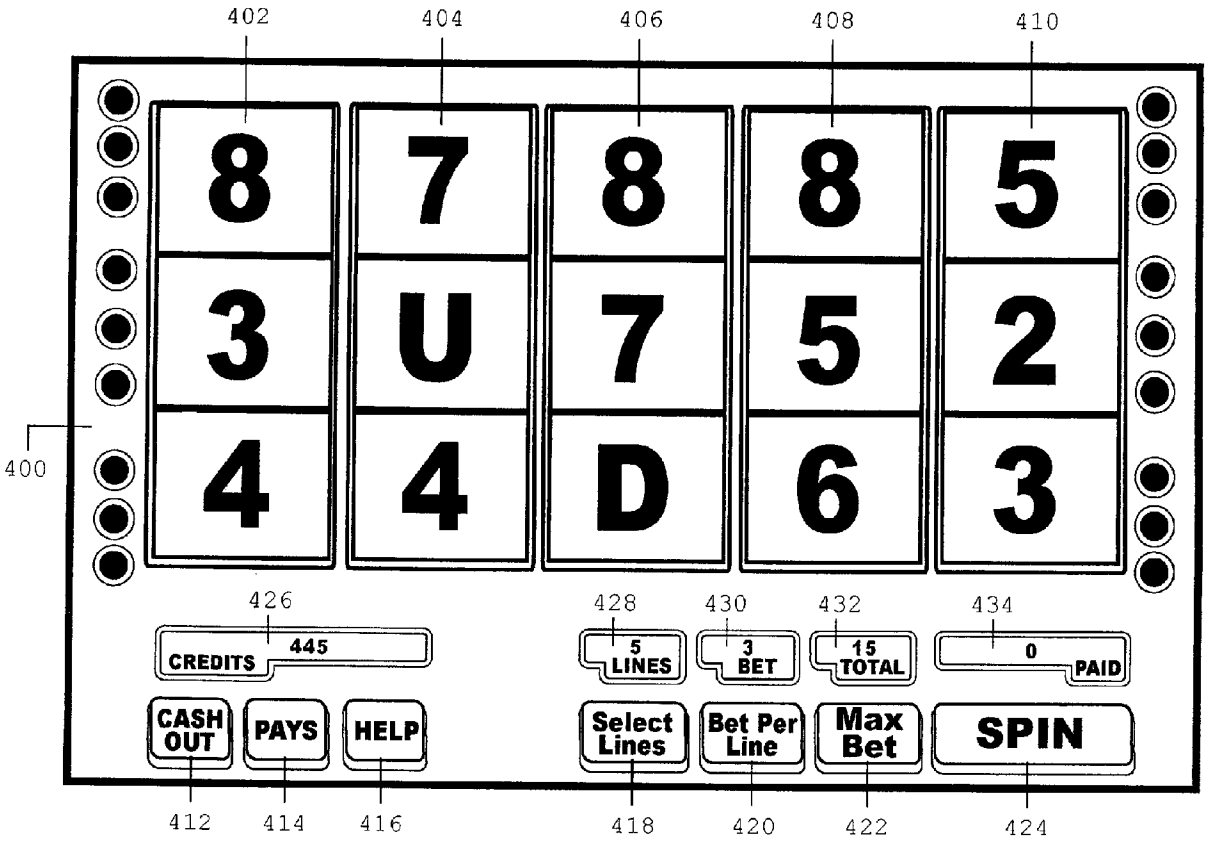
Figure 6:
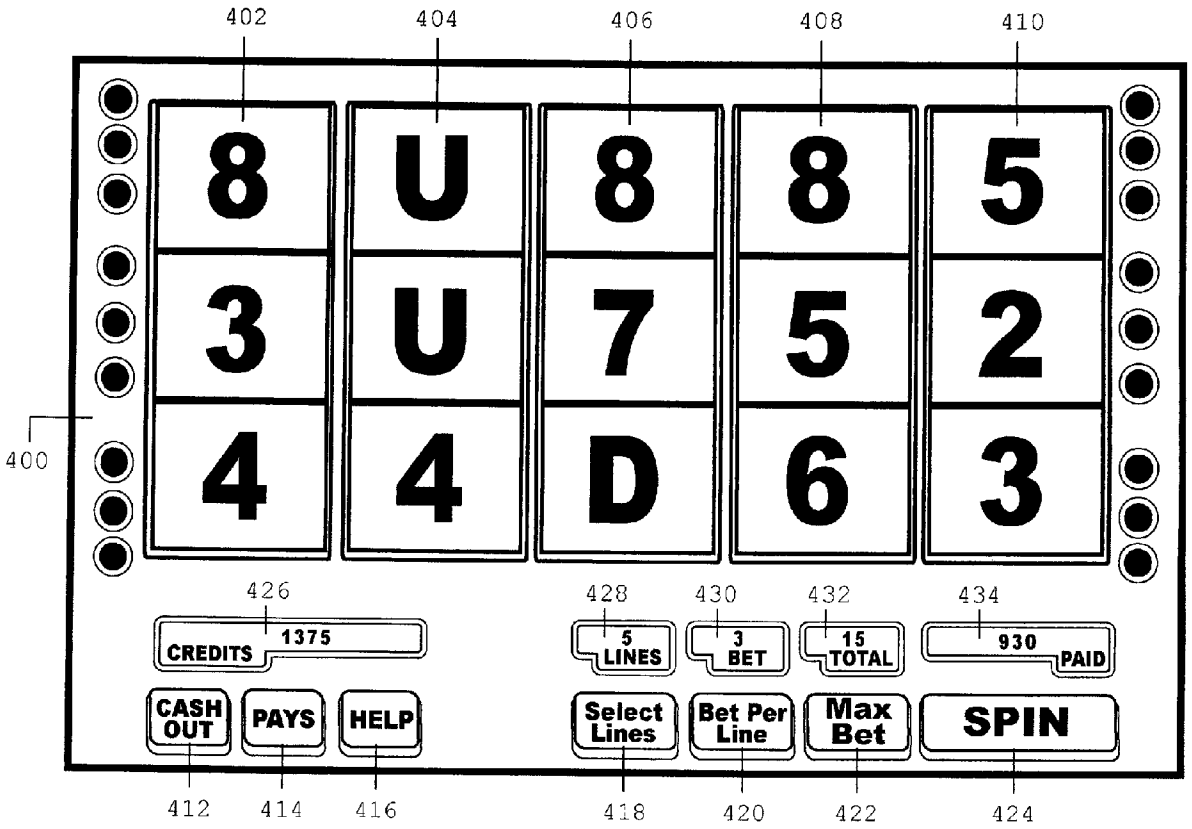

FIGS. 3-10 show different types of winning symbol combinations: FIGS. 3-8 show line pays formed using base symbols and directional wild symbols on the slot reels 402-410. FIGS. 1 and 2 show the slot reels before and after the expansion of the directional wild symbols. In FIG. 3, a downward directional wild symbol ("D") appears in the top symbol position of slot reel 406. FIG. 4 provides the D symbol expands downwards into the middle and bottom symbol positions of reel 406. FIGS. 5 and 6 show the slot reels before and after the expansion of the directional wild symbols. In FIG. 5, an upward direction symbol ("U") appears in the middle position of slot reel 404 and a D symbol appears in the bottom symbol position of slot reel 406. In FIG. 6, the U expands upwards into the top position of slot reel 404 and the D does not expand since it is already in the bottom position of slot reel 406.

FIGS. 7 and 8 show the slot reels before and after the expansion of the directional wild symbols. FIG. 7 provides a U symbol appears in the top position of slot reel 404, a D symbol appears in the top symbol position of slot reel 406, and another U symbol appears in the bottom position of slot reel 408. In FIG. 8, the U does not expand since it is already in the top position of slot reel 404. The D expands downwards into bottom position of slot reel 406, and the other U symbol expands into the middle and top positions of slot reel 408. FIG. 9 shows a line-scatter pay of two "10" symbols on pay line 1, at slot reels 402 and 406. FIG. 10 shows a reel-scatter pay of three "11" symbols on slot reels 404, 406, and 410. Alternatively, any pre-determined arrangement of symbols may be designated as winning symbol combinations.

In a base example game, an individual "Sam Slotsky," is standing in front of a nickel-denomination version of an embodiment of the present invention. Sam sees slot game on the slot game on a video display 400, illustrated for example in FIG. 3. The slot game uses a 5-column by 3-row symbol matrix, as shown on the slot reels 402-410. For this example, video display 400 is populated with symbols and/or information described below which replaces the symbols and/or information currently displayed in FIG. 3.

Below the video display 400, the button panel holds seven buttons: Cash Out 412, Pay Table 414, Help 416, Select Pay Lines 418, Bet Per Line 420, Bet Max 422, and Spin 424. In addition, there are also five meters on the video display 400 below the game: Credits 426, Number of Pay Lines 428, Amount Bet Per Line 430, Total Bet 432 and Paid 434.

Figure 11:
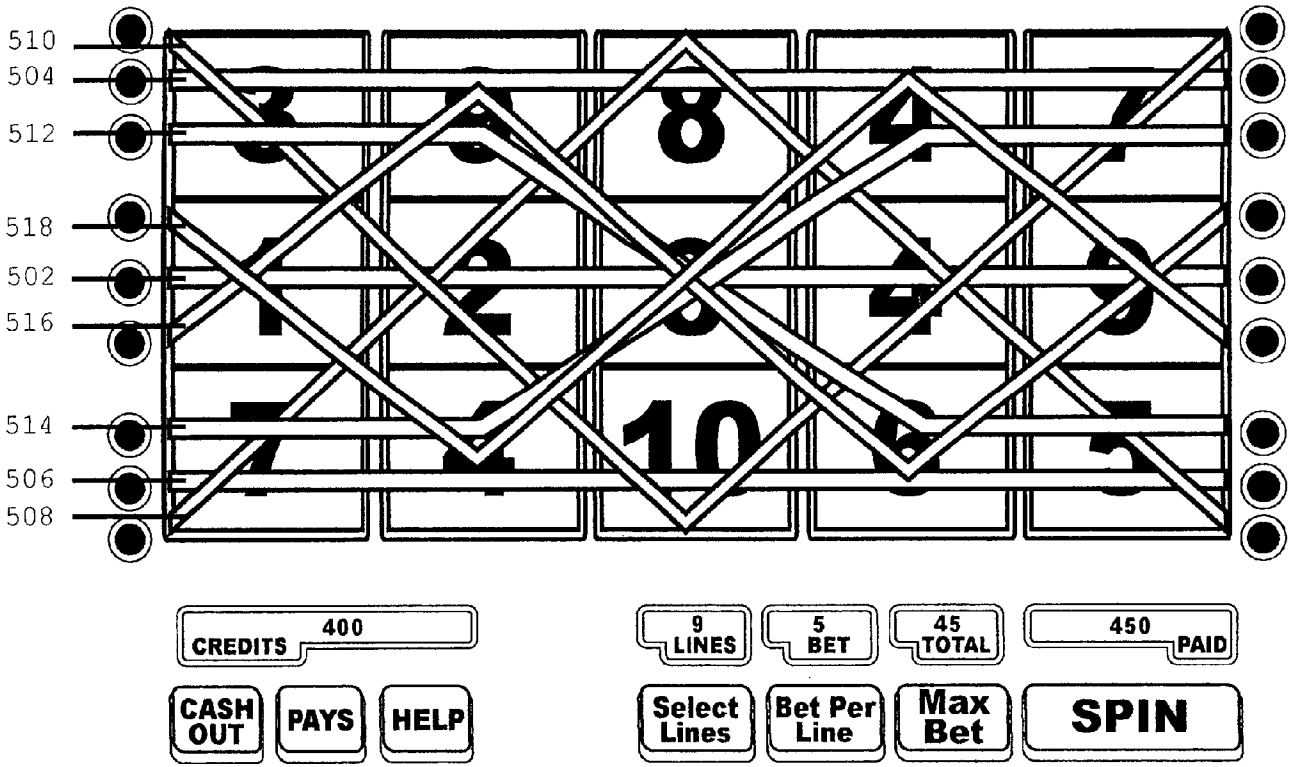
FIG. 11 shows exemplary player-selected pay lines in accordance with one embodiment of the present invention.

Sam presses the Pay Table button 414 to view the pays for winning combinations. After viewing the pay table, Sam deposits $20 into the bill receptor and the Credits meter 426 counts up from 0 to 400 since the denomination for this game is five cents per credit. Sam then his chooses the wager for the game: The game's Number of Pay Lines meter 428 reads 1. Sam presses the Select Pay Lines button 418 four times and the Number of Pay Lines meter 428 counts up from 1 to 5. An exemplary set of paylines used in this example is illustrated in FIG. 11. As Sam presses the Select Pay Lines button 418, the video display 400 shows the locations of each selected pay line on the slot reels 402-410. For example, the first pay line 502 starts in the middle row of slot reel 402 and proceeds in the straight line through the middle position of slot reels 404-410; The game's Amount Bet Per Line meter 430 reads 1. Sam presses the Bet Per Line button 420 two times and the Amount Bet Per Line meter 430 counts up from 1 to 3; The Total Bet meter 432 started at 1, but after Sam's adjustments it now reads 15; and The Paid meter 434 reads 0.

After setting his wager, Sam presses the spin button 424. The Credits meter 426 counts down from 400 to 385. The slot reels 402-410 spin, stop, and display a variety of symbols. The "before" symbol matrix contained no winning combinations. The "after" symbol matrix, however, contains a winning 5-5-D combination on pay line 1 at 502. The winning combination is formed by the extension of the D wild symbol from the top position of slot reel 406 into the middle and bottom positions of slot reel 406.

The game awards 75 credits for the winning symbol combination of 5-5-D. The D symbol is wild and acts as a 5 symbol to make the 5-5-5 combination. The 75 credit award reflects the game's pay table which states that 5-5-5 pays 25 credits for each credit wagered upon the pay line (e.g., 25 credits times 3 credits wagered on the pay line). The Credits meter 426 counts up from 385 to 460 and the game Paid meter 434 reads 75.

Again, Sam presses the spin button 424. The Credits meter 426 counts down from 460 to 445. The slot reels 402-410 spin, stop, and display other symbols. The "before" symbol matrix contains 2 winning combinations of 8-U-D on pay line 4 at 508 and 4-4-D on pay line 3 at 506. The "after" symbol matrix, contains an additional winning combination of 8-U-8-8 on pay line 1 at 502. The additional winning combination is formed by the extension of the U wild symbol from the middle position of slot reel 404 into the top position of slot reel 404.

The game awards 930 credits for the winning combinations, as follows: The game awards 300 credits for the winning symbol combination of 8-U-D. The U and D symbols are wild and act as 8 symbols to make the 8-8-8 combination. The 300 credit award reflects the game's pay table which states that 8-8-8 pays 100 credits for each credit wagered upon the pay line (e.g., 100 credits times 3 credits wagered on the pay line). The game awards 30 credits for the winning symbol combination of 4-4-D. The D symbol is wild and acts as a 4 symbol to make the 4-4-4 combination. The 30 credit award reflects the game's pay table which states that 4-4-4 pays 10 credits for each credit wagered upon the pay line (e.g., 10 credits times 3 credits wagered on the pay line). The game awards 600 credits for the winning symbol combination of 8-U-8-8. The U symbol is wild and act as an 8 symbol to make the 8-8-8-8 combination. The 600 credit award reflects the game's pay table which states that 8-8-8-8 pays 200 credits for each credit wagered upon the pay line (e.g., 200 credits times 3 credits wagered on the pay line).

The Credits meter 426 counts up from 445 to 1375 and the game Paid meter 434 reads 930. Again, Sam presses the spin button 424. The Credits meter 426 counts down from 460 to 445. The slot reels 402-410 spin, stop, and display additional symbols. The "before" symbol matrix contains 1 winning combination of 3-U-3 on pay line 2 at 504. The "after" symbol matrix, extends the 3-U-3 combination into 3-U-3-U-3 and also contains an additional 2 winning combinations of 4-4-D-U on pay line 3 at 506 and 3-3-D-U-3 on pay line 4 at 508. The additional winning combinations are formed by the extension of the D wild symbol from the middle position of slot reel 406 into the bottom position of slot reel 406 and the extension of the U wild symbol from the bottom position of slot reel 408 into the middle and top position of slot reel 408.

The game awards 300 credits for the winning combinations, as follows: The game awards 120 credits for the winning symbol combination of 3-U-3-U-3. The U symbols are wild and act as 3 symbols to make the 3-3-3-3-3 combination. The 120 credit award reflects the game's pay table which states that 3-3-3-3-3 pays 40 credits for each credit wagered upon the pay line (e.g., 40 credits times 3 credits wagered on the pay line). It should be noted that the game only awards credits for the 3-U-3-U-3 combination formed after expansion; no credits are issued for the 3-U-3 combination formed before expansion. However, in alternative embodiments, credits may be issued prior to, and after expansion. The game awards 60 credits for the winning symbol combination of 4-4-D-U. The D and U symbols are wild and acts as 4 symbols to make the 4-4-4-4 combination. The 60 credit award reflects the game's pay table which states that 4-4-4-4 pays 20 credits for each credit wagered upon the pay line (e.g., 20 credits times 3 credits wagered on the pay line). The game awards 120 credits for the winning symbol combination of 3-3-D-U-3. The U symbols are wild and act as 3 symbols to make the 3-3-3-3-3 combination. The 120 credit award reflects the game's pay table which states that 3-3-D-U-3 pays 40 credits for each credit wagered upon the pay line (e.g., 40 credits times 3 credits wagered on the pay line).

The Credits meter 426 counts up from 1360 to 1660 and the game Paid meter 434 reads 300. Content with his winnings, Sam presses the Cash Out button 412. The gaming device issues 1660 nickels or any other form of currency, including cash, an EZ-PAY™ ticket, or electronic payment.

During play of the base game, the player may receive pays for additional features, such as line and reel scatter pays. FIGS. 9 and 10 show scatter pays that award the player a predetermined payout for the appearance of line and reel scatter symbols on the slot reels 402-410. FIG. 9 shows a "line scatter pay" that issues awards for the 2 scatter symbols "11" on pay line 1 at 502; and FIG. 10 shows a "reel scatter pay" that issues awards for 3 scatter symbols "12" on the slot reels 402-410.

It should be noted that the U and D directional wild symbols in FIGS. 9 and 10 do not act as scatter symbols. Alternatively, directional wild symbols may also act as any or all types of scatter symbols, and optionally simultaneously therewith.

The Scatter pays illustrated in FIGS. 9 and 10 issue a specific number of credits. The credits may be issued immediately or after the completion of a bonus feature e.g., animation sequence or animated bonus game). The calculation of the scatter pay award depends on the type of scatter pay: For the line scatter pay, the number of credits wagered on the winning pay line multiplies the number of credits indicated by the pay table. In FIG. 9, the player wagered three credits each on five pay lines and collected three times the amount indicated on the pay table. For the reel scatter pay, the total number of credits wagered multiplies the number of credits indicated by the pay table. In FIG. 10, the player wagered fifteen total credits and collected fifteen times the amount indicated on the pay table. Alternatively, any award schedule may be used to pay for any pre-determined arrangement of scatter symbols—line-scatter or reel-scatter.

A variety of additional alternative embodiments of such type of system are disclosed by commonly owned U.S. Pat. No. 7,758,414, the disclosure of which is incorporated by reference herein in its entirety. In addition, certain features of U.S. patent application Ser. No. 12/221,658 are related to features of embodiments of the present invention, and the disclosure of such reference is hereby incorporated by reference herein in its entirety.

Embodiments of the present invention further include a variety of methods of play that can be programmed on an electronic video slot machine to enable wild symbols to be created in the play matrix. In a first exemplary method, "activated wilds" comprises wild versions of certain designated symbols placed on the reel strips, in addition to the regular versions of these symbols. If a wild version of a symbol appears in the play matrix then every regular version of the same symbol changes into its wild version, prior to any win evaluation. In an alternate embodiment, the presence of a designated symbol in the play matrix causes all symbols in a designated subset of the symbol set which also appear in the play matrix to change into wild symbols prior to the win evaluation.

In a second exemplary method, "wild connections" comprises one or more symbols on the reel strips designated as activator symbols. The presence of these activator symbols in the play matrix on a given spin causes symbols in certain predetermined positions in the symbol matrix to change into wild symbols. In many embodiments, if two such symbols appear in the play matrix then every symbol which occupies a position in the matrix on any connected pay line which includes both activator symbols is changed into a wild symbol.

In yet another embodiment, if two such activator symbols appear in the play matrix on the same row then every symbol on the row between them, as well as the activator symbols themselves are changed into wild symbols prior to the win evaluation. In an additional embodiment, if two such activator symbols appear in the play matrix on the same reel then every symbol on the reel between them, as well as the activator symbols themselves are changed into wild symbols prior to the win evaluation It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. For example, an element disclosed by one embodiment of the present invention may be included in any other disclosed embodiment, where suitable.

All such modifications and variations are intended to be included herein within the scope of this disclosure and the present invention.

What is claimed is:

1. A gaming device comprising:

a display device;

an input device; and a processor for accessing a plurality of instructions which, when executed by the processor, cause the processor to operate with the display device and the input device to, for a play of a game:

(a) receive at least one wager on at least one payline;

(b) at each of a plurality of symbol positions of a plurality of reels, display a symbol selected from a plurality of symbols including at least one designated symbol, the designated symbol having both a wild form and a non-wild form;

(c) if a triggering event occurs:

(i) replace the non-wild form of at least one of any designated symbols displayed at any symbol positions with the wild form of the designated symbol, and (ii) for each wagered on payline:

(A) determine any awards associated with any winning symbol combinations formed from the plurality of symbols displayed along said wagered on payline, wherein said determination is based, at least in part, on the wild form of the at least one of any designated symbols displayed at any symbol positions along said wagered on payline, and (B) display any determined awards associated with any formed winning symbol combinations; and (d) if the triggering event does not occur, for each wagered on payline:

(i) determine any awards associated with any winning symbol combinations formed from the plurality of symbols displayed along said wagered on payline, and (ii) display any determined awards associated with any formed winning symbol combinations.

2. The gaming device of claim 1, wherein the triggering event occurs if the wild form of one designated symbol is displayed at one of the symbol display positions.

3. The gaming device of claim 1, wherein when executed by the processor, the plurality of instructions cause the processor to, if the triggering event occurs, replace the non-wild form of each of any designated symbols displayed at any symbol position with the wild form of the designated symbol.

4. The gaming device of claim 1, wherein when executed by the processor, the plurality of instructions cause the processor to, if the triggering event occurs, replace at least one displayed symbol with a wild symbol, the at least one displayed symbol is different than any displayed designated symbol.

5. The gaming device of claim 1, wherein the triggering event occurs if at least one of the displayed symbols is an activator symbol.

6. The gaming device of claim 5, wherein when executed by the processor, the plurality of instructions cause the processor to, if the triggering event occurs, replace the non-wild form of at least one of any designated symbol displayed at a symbol position relative to the symbol position of the activator symbol with the wild form of the designated symbol.

7. The gaming device of claim 1, wherein the triggering event occurs if at least two of the displayed symbols are activator symbols.

8. The gaming device of claim 7, wherein when executed by the processor, the plurality of instructions cause the processor to, if the triggering event occurs, replace at least one displayed symbol with a wild symbol, the at least one displayed symbol is displayed in a symbol position relative to the symbol positions of the activator symbols.

9. The gaming device of claim 7, when executed by the processor, the plurality of instruction cause the processor to, if the triggering event occurs, replace at least one of the activator symbols with a wild symbol.

10. A method of operating a gaming device, said method comprising:

(a) receiving at least one wager on at least one payline;

(b) at each of a plurality of symbol positions of a plurality of reels, causing a display device to display a symbol selected from a plurality of symbols including at least one designated symbol, the designated symbol having both a wild form and a non-wild form;

(c) if a triggering event occurs:

(i) causing a processor to replace the non-wild form of at least one of any designated symbols displayed at any symbol positions with the wild form of the designated symbol, and (ii) for each wagered on payline:

(A) causing the processor to determine any awards associated with any winning symbol combinations formed from the plurality of symbols displayed along said wagered on payline, wherein said determination is based, at least in part, on the wild form of the at least one of any designated symbols displayed at any symbol positions along said wagered on payline, and (B) causing the display device to display any determined awards associated with any formed winning symbol combinations; and (d) if the triggering event does not occur, for each wagered on payline:

(i) causing the processor to determine any awards associated with any winning symbol combinations formed from the plurality of symbols displayed along said wagered on payline, and (ii) causing the display device to display any determined awards associated with any formed winning symbol combinations.

11. The method of claim 10, wherein the triggering event occurs if the wild form of one designated symbol is displayed at one of the symbol display positions.

12. The method of claim 10, which includes, if the triggering event occurs, causing the processor to replace the non-wild form of each of any designated symbols displayed at any symbol position with the wild form of the designated symbol.

13. The method of claim 10, which includes, if the triggering event occurs, causing the processor to replace at least one displayed symbol with a wild symbol, the at least one displayed symbol is different than any displayed designated symbol.

14. The method of claim 10, wherein the triggering event occurs if at least one of the displayed symbols is an activator symbol.

15. The method of claim 14, which includes, if the triggering event occurs, causing the processor to replace the non-wild form of at least one of any designated symbol displayed at a symbol position relative to the symbol position of the activator symbol with the wild form of the designated symbol.

16. The method of claim 10, wherein the triggering event occurs if at least two of the displayed symbols are activator symbols.

17. The method of claim 14, which includes, if the triggering event occurs, causing the processor to replace at least one displayed symbol with a wild symbol, the at least one displayed symbol is displayed in a symbol position relative to the symbol positions of the activator symbols.

18. The method of claim 14, which includes, if the triggering event occurs, causing the processor to replace at least one of the activator symbols with a wild symbol.

* * * * *

UNITED STATES PATENT AND TRADEMARK OFFICE

CERTIFICATE OF CORRECTION

PATENT NO. : 9,005,006 B2
APPLICATION NO. : 13/572583
DATED : April 14, 2015
INVENTOR(S) : Haykin et al.

It is certified that error appears in the above-identified patent and that said Letters Patent is hereby corrected as shown below:

IN THE CLAIMS

Claim 4, Column 17, Line 54, replace “is” with --being--.
Claim 8, Column 18, Line 5, replace “is” with --being--.
Claim 9, Column 18, Line 7, between “,” and “when” insert --wherein--.
Claim 9, Column 18, Line 8, replace “instruction” with --instructions--.
Claim 13, Column 18, Line 55, replace “is” with --being--.
Claim 17, Column 19, Line 4, replace “is” with --being--.

Signed and Sealed this
Twenty-second Day of September, 2015

Michelle K. Lee

Michelle K. Lee
*Director of the United States Patent and Trademark Office*